US011731246B2

(12) United States Patent
Chen

(10) Patent No.: US 11,731,246 B2
(45) Date of Patent: Aug. 22, 2023

(54) PLIERS

(71) Applicant: Jin Fu Chen, Taichung (TW)

(72) Inventor: Jin Fu Chen, Taichung (TW)

( * ) Notice: Subject to any disclaimer, the term of this patent is extended or adjusted under 35 U.S.C. 154(b) by 141 days.

(21) Appl. No.: 17/484,064

(22) Filed: Sep. 24, 2021

(65) Prior Publication Data

US 2022/0009058 A1 Jan. 13, 2022

Related U.S. Application Data

(63) Continuation-in-part of application No. 16/521,882, filed on Jul. 25, 2019, now abandoned, which is a continuation-in-part of application No. 15/827,150, filed on Nov. 30, 2017, now abandoned.

(51) Int. Cl.
*B25B 7/14* (2006.01)

(52) U.S. Cl.
CPC ..... *B25B 7/14* (2013.01)

(58) Field of Classification Search
CPC .... B25B 7/14; B25B 7/16; B25B 7/06; B26B 13/16
USPC ..... 81/318, 60
See application file for complete search history.

(56) References Cited

U.S. PATENT DOCUMENTS 8,079,150 B2 * 12/2011 Huang ..... A01G 3/02 30/261
2021/0101260 A1 * 4/2021 Liedtke ..... B25B 7/14

* cited by examiner

*Primary Examiner* — Hadi Shakeri
(74) *Attorney, Agent, or Firm* — Rosenberg, Klein & Lee

(57) ABSTRACT

A pliers includes a first body with an engaging groove and a second body with an elongated slot pivotally connected with each other. The elongated slot includes a left and right positioning grooves and a protruding portion disposed therebetween. A tap button is pivotally connected to the second body. A supporting member is disposed between the second body and the tap button. When the first body comes close to the second body, the tap button can be tapped to a first position and engaged in the engaging groove. Thus, the first body is blocked and cannot pivot relative to the second body. The tap button can be tapped to a second position and detached from the engaging groove. Thus, the first body is pivotable relative to the second body. A positioning block is extending from the tap button and can be engaged in any of the positioning grooves for positioning the tap button.

4 Claims, 10 Drawing Sheets

PLIERS

REFERENCE TO RELATED APPLICATIONS

This Application is being filed as a Continuation-in-Part application of Ser. No. 16/521,882, filed Jul. 25, 2019, currently pending, which was filed as a Continuation-in-Part of application Ser. No. 15/827,150, filed 30 Nov. 2017, which is now abandoned.

BACKGROUND OF THE INVENTION

Field of the Invention

The present invention relates to a pliers, in particular to a tap button structure of the pliers.

Description of the Prior Art

As shown in FIG. 10, a conventional pliers is illustrated. On one of the pliers bodies 51, a tap button 6 is assembled with a shaft 61. When the two pliers bodies 51, 52 are in a closed state, the tap button 6 can be tapped inwardly to abut against the pliers body 52. Therefore, the two pliers bodies 51, 52 are positioned with each other and cannot be pivoted relative to each other. Hence, when the conventional pliers is not in use, the pliers can be kept in the closed state to prevent from hurting the user unintentionally. When the user tends to use the pliers, the tap button 6 can be tapped outwardly, so that the two pliers bodies 51, 52 can be pivoted relative to each other, and then the user can use the pliers.

However, although the tap button 6 can be used to position the two pliers bodies 51, 52 with each other, the tap button 6 is devoid of a positioning mechanism. In other words, the tap button 6 is freely pivotable relative to the pliers body 51. Even if the tap button 6 is tapped inwardly and the two pliers bodies 51, 52 are positioned with each other, a foreign force may be applied on the tap button 6 to make the tap button 6 have unexpected rotation and detach from the pliers body 52. As a result, the pliers bodies 51, 52 of the conventional pliers are not firmly pivoted with each other when the conventional pliers is in the closed state, and the pliers may still be opened to hurt the user in an unintentional manner.

SUMMARY OF THE INVENTION

One object of the present invention is to provide a pliers having a structure for positioning the tap button to prevent the unwanted movements of the pliers bodies from each other and the change of the opened/closed state of the pliers.

In view of these, a pliers is provided. In one embodiment, the pliers comprise a first pliers body, a second pliers body, and a tap button. The first pliers body has an engaging groove. The second pliers body is pivoted with the first pliers body, so that the first pliers body is pivotable relative to the second pliers body to come close to or goes away from the second pliers body. The engaging groove is faced to the second pliers body. A curve-shape elongated slot is disposed on the second pliers body and includes a left positioning groove, a right positioning groove and a protruding portion provided between the left and right positioning grooves. The tap button has a blocking portion formed at a front end thereof. The tap button faces the second pliers body with a bottom surface and is pivoted on the second pliers body. The bottom surface is provided with an elastic positioning block extending toward the elongated slot and selectively inserting into the left or right positioning groove. The tap button is positioned with the positioning block stopped laterally by the protruding portion. When the first pliers body comes close to the second pliers body, the tap button is capable of being rotatably tapped to make the positioning block cross over the protruding portion and insert into the left engaging groove, so that the first pliers body is blocked by the blocking portion locating in the engaging groove and cannot pivot relative to the second pliers body. The tap button is capable of being rotatably tapped to make the positioning block cross the protruding portion and shift into the right positioning groove for detaching the blocking portion from the engaging groove, so that the first pliers body is pivotable relative to the second pliers body. A supporting member is disposed between the second pliers body and the bottom surface of the tap button to push the tap button away from the second pliers body.

Preferably, the supporting member is a broken ring with two ends leave away from each other. One end is higher than the other end.

In one embodiment, the tap button is covered by a housing. The tap button is pivoted on the second pliers body by a shaft, and the housing comprises a receiving groove corresponding to the shaft.

DETAIL DESCRIPTION OF THE PREFERRED EMBODIMENTS

Figure 1:
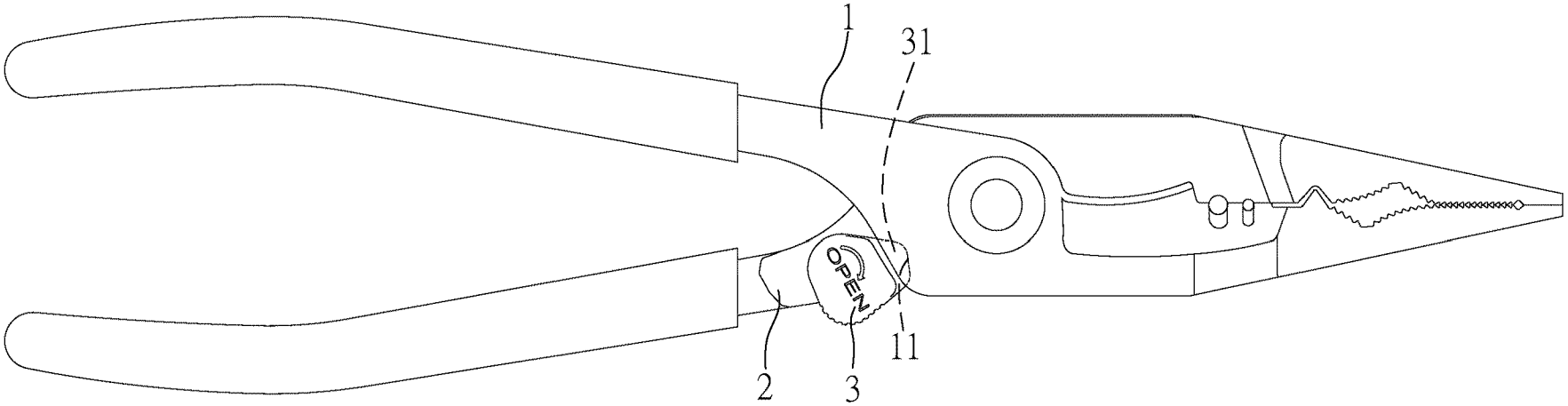
FIG. 1 illustrates a plan view of the pliers of the first embodiment.
Figure 2:
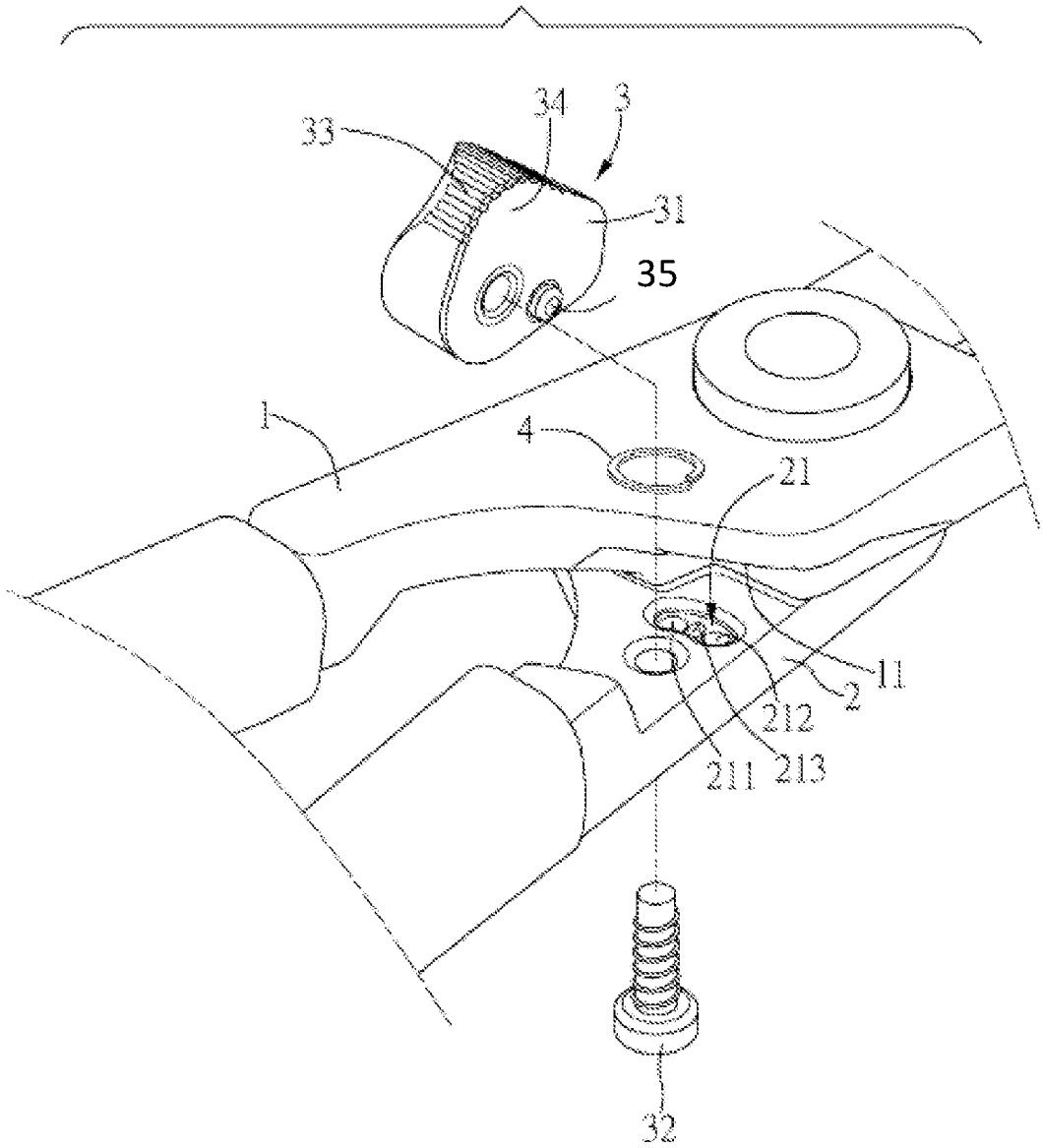
FIG. 2 illustrates an exploded view of the pliers of the first embodiment.

Please refer to FIGS. 1 and 2, illustrating a pliers according to a first embodiment of the present invention. In this embodiment, the pliers comprise a first pliers body 1, a second pliers body 2, and a tap button 3. The first pliers body 1 is pivoted with the second pliers body 2, and a spring is received in a pivoting portion between the first pliers body 1 and the second pliers body 2, so that the first pliers body 1 is away from the second pliers body 2 in a normal state. The first pliers body 1 is pivotable relative to the second pliers body 2 to come close to or goes away from the second pliers body 2 for performing a cutting function. The first pliers body 1 comprises an engaging groove 11, and the engaging groove 11 is on one side of the first pliers body 1 and near the pivoting portion.

Moreover, tap button 3 is pivoted on the second pliers body 2 and near the pivoting portion by a shaft 32, and the tap button 3 is capable of being tapped to a first position and a second position. A blocking portion 31 is disposed at a front end of the tap button 3. When the first pliers body 1 and the second pliers 2 are closed with each other, the tap button 3 can be tapped to the first position, so that the blocking portion 31 is engaged in the engaging groove 11 of the first pliers body 1. Therefore, the first pliers body 1 is blocked by the tap button 3 and cannot pivoted relative to the second pliers body 2, and the pliers cannot be opened. In this embodiment, as shown in FIG. 1, the outline of the tap button 3 is round and smooth. Hence, when the blocking portion 31 is engaged in the engaging groove 11, the tap button 3 is closely and seamlessly attached on the first pliers body 1. Therefore, the tap button 3 would not engage with unwanted tool pieces to affect the operation of the pliers. Conversely, when the tap button 3 is tapped to the second position, the blocking portion 31 of the tap button 3 is detached from the engaging groove 11. Therefore, the first pliers body 1 is pivotable relative to the second pliers body 2, and the pliers can be opened.

In one embodiment, the tap button 3 may have an anti-skid pattern 33 for stable operation.

The second pliers body 2 includes an elongated slot 21, and the outline of the elongated slot 21 is curved to correspond to a trace of the tap button 3. The elongated slot 21 further includes a left positioning groove 211, a right positioning groove 212 and a protruding portion 213 provided between the left and right positioning grooves 211, 212. The tap button 3 has a bottom surface 34 facing the second pliers body 2. An elastic positioning block 35 that is deformable is disposed on the bottom surface 34 and can be engaged in any of the left and right positioning grooves 211, 212 according to the position of the tap button 3 for positioning the tap button 3.

Figure 3:
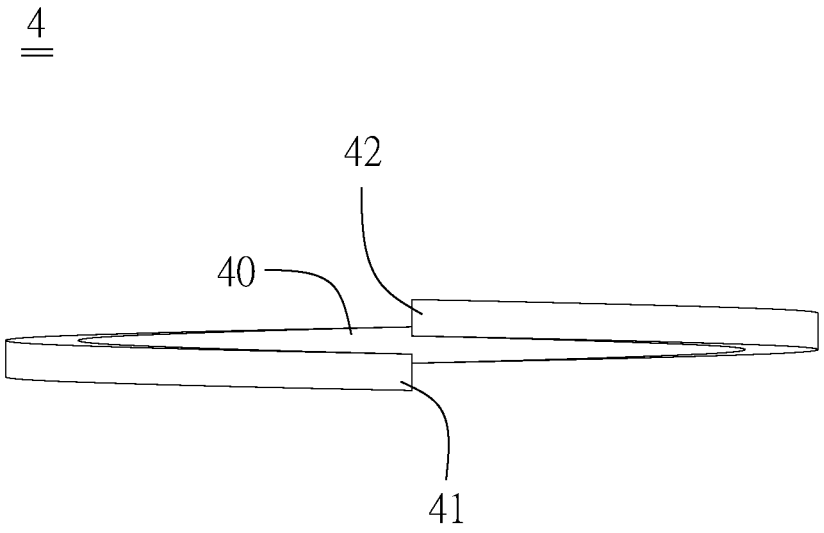
FIG. 3 illustrates a plan view of the supporting member of the first embodiment.
Figure 4:
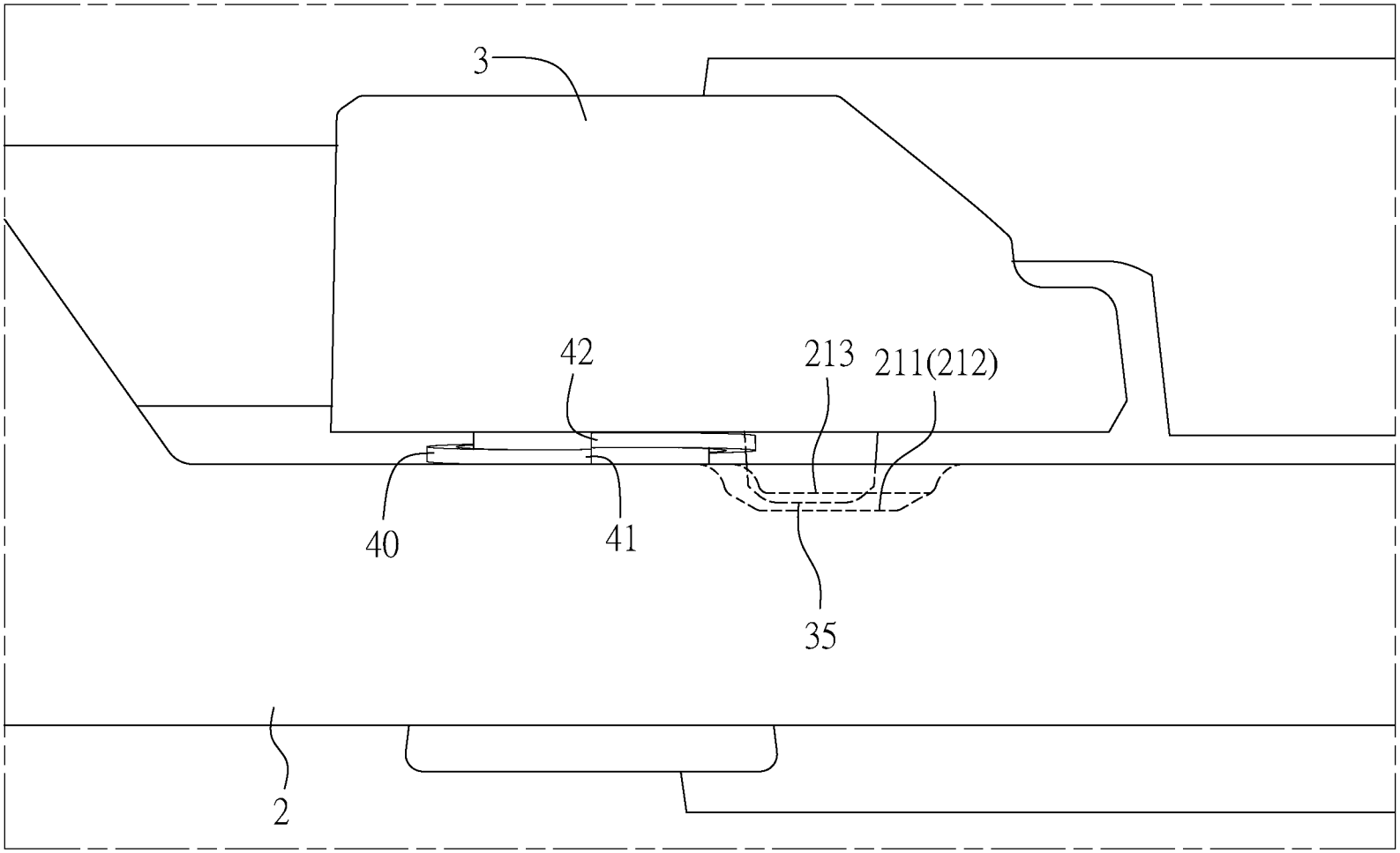
FIG. 4 illustrates a side view of the pliers of the first embodiment.

A supporting member 4 is provided between the second pliers body 2 and the bottom surface 34 of the tap button 3 to push the tap button 3 away from the second pliers body 2. In this embodiment, as shown in FIG. 3, the supporting member is a broken ring 40 with a first end 41 and a second end 42 leave away from each other. The broken ring 40 forms like a spiral so that the second end 42 is higher than the first end 41 rather than leveled. Therefore, referring to FIG. 4, the tap button 3 is pushed away from the second pliers body 2 by a distance between the first end 41 and the second end 42.

Figure 5:
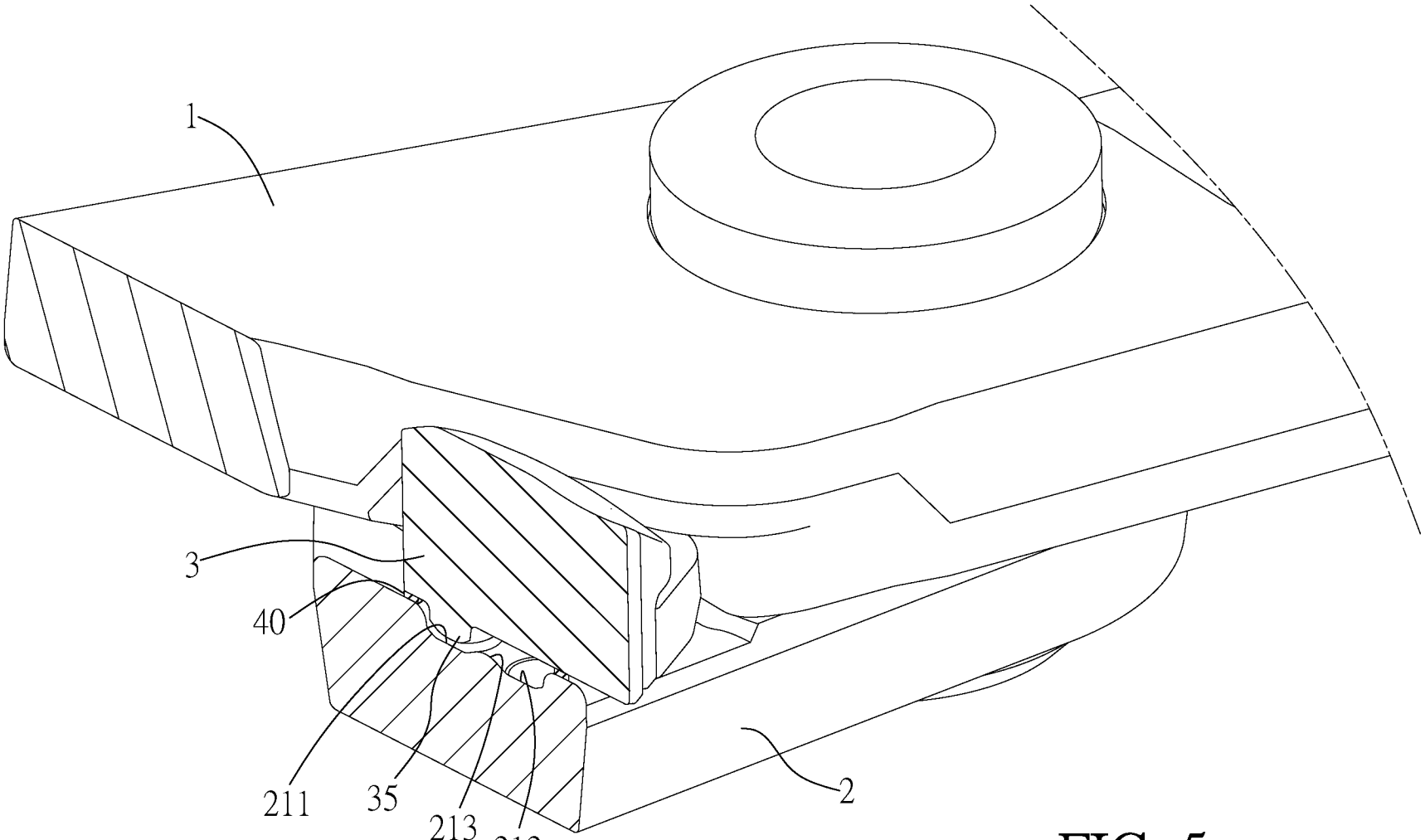
FIGS. 5 to 7 illustrate sectional views showing operations of the pliers of the first embodiment.

As above, as shown in FIG. 5, when the first pliers body 1 comes close to the second pliers body 2 and the tap button 3 is tapped to the first position for positioning the first pliers body 1, the positioning block 35 of the tap button 3 is engaged in the left positioning groove 211, so that the tap button 3 is positioned with the positioning block 35 stopped laterally by the protruding portion 213 and the left positioning groove 211. In other words, when a foreign force having a magnitude not greater than a certain value is applied to the tap button 3, the tap button 3 is not moved. Accordingly, the tap button 3 can be kept engaged into the engaging groove 11, so that the first pliers body 1 can be prevented from being pivoted relative to the second pliers body 2 and the pliers would not be opened unintentionally.

Figure 6:
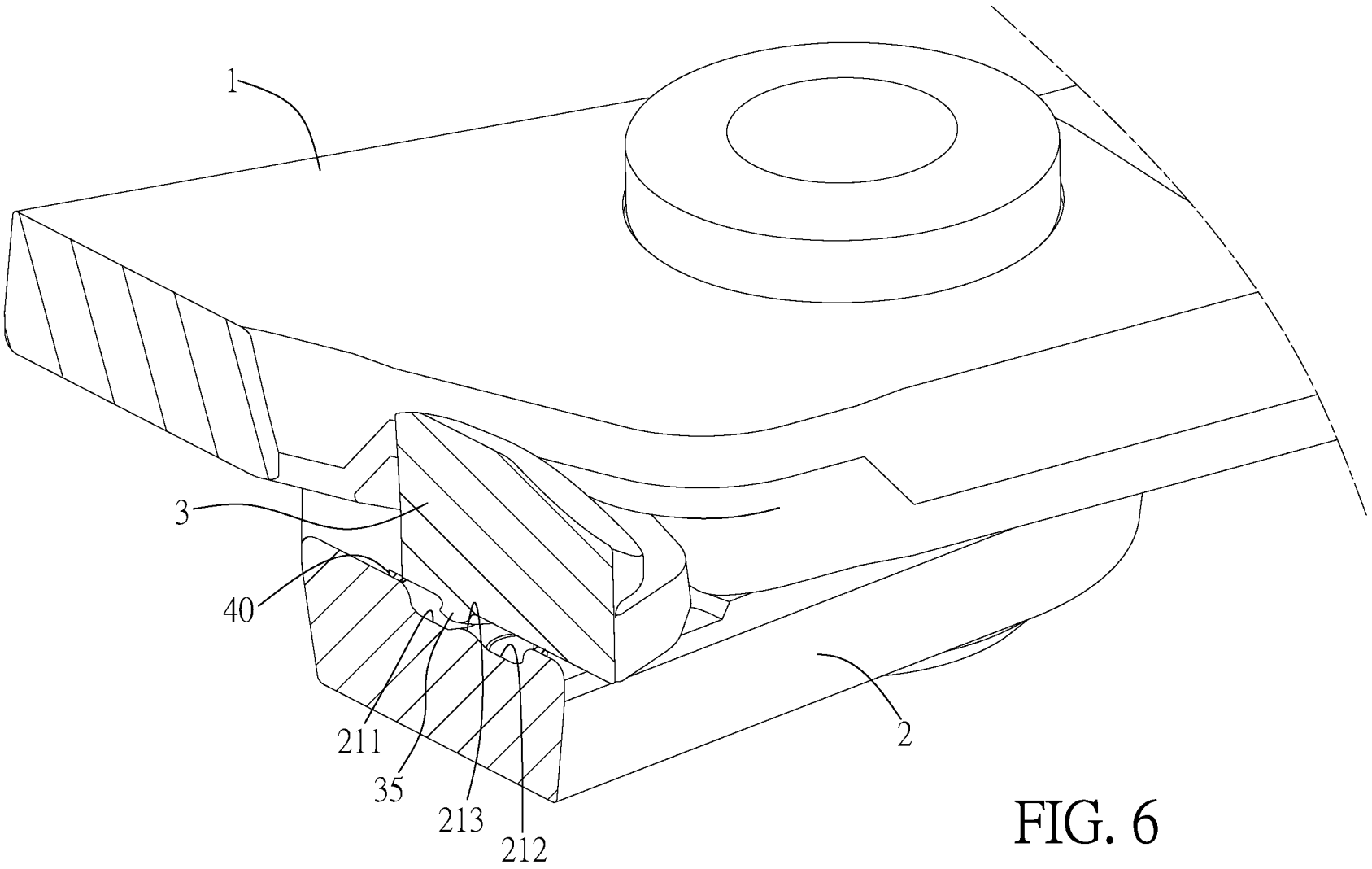
Figure 7:
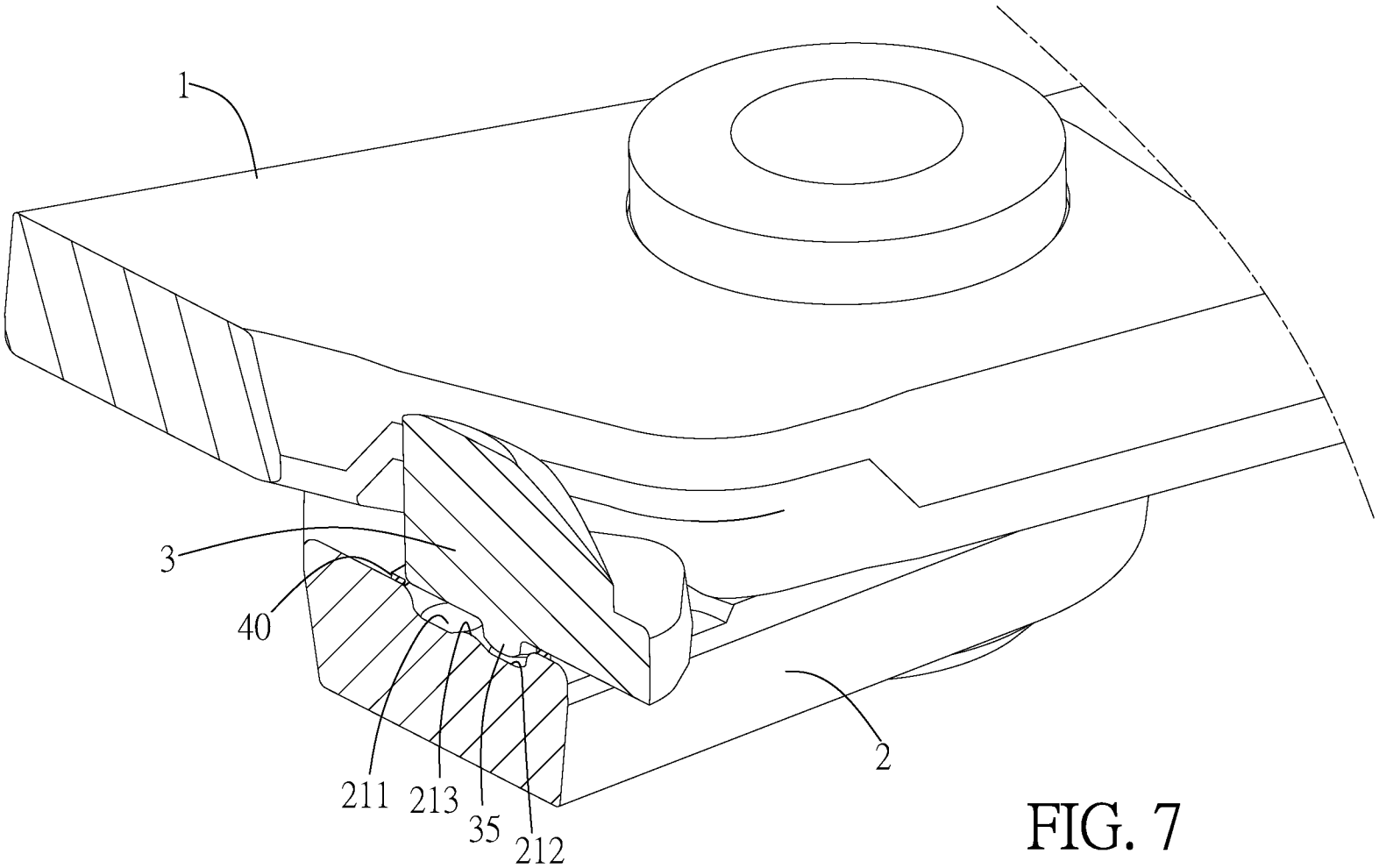

Conversely, when the pliers is to be used, the user can apply a force to the tap button 3 to tap the tap button 3 from the first position to the second position, then the tap button 3 is detached from the engaging groove 11 and the first pliers body 1 is freely pivotable relative to the second pliers body 2. As shown in FIG. 6, during the movement of the tap button 3, firstly, the positioning block 35 is detached from the left positioning groove 211. And then, because the positioning block 35 can be deformed when being compressed, the positioning block 35 goes across the protruding portion 213, moves to the right positioning groove 212, and engaged in the right engaging groove 212, as shown in FIG. 7. Accordingly, the tap button 3 can be positioned at the second position with the positioning block 35 stopped laterally by the protruding portion 213 and the right engaging groove 212. Furthermore, as mentioned above, the tap button 3 is not moved by a force having a magnitude not greater than a certain value. Therefore, the tap button 3 can be prevented from being tapped in the engaging groove 11 unintentionally to affect the operation of the pliers.

The positioning block 35 is raised as a result of the tap button 3 being supported by the broken ring 40 so as to easily cross over the protruding portion 213 in the course of tapping the tap button 3 for the tap button 3 shifting between the left and right positioning grooves 211, 212 more smoothly.

Figure 8:
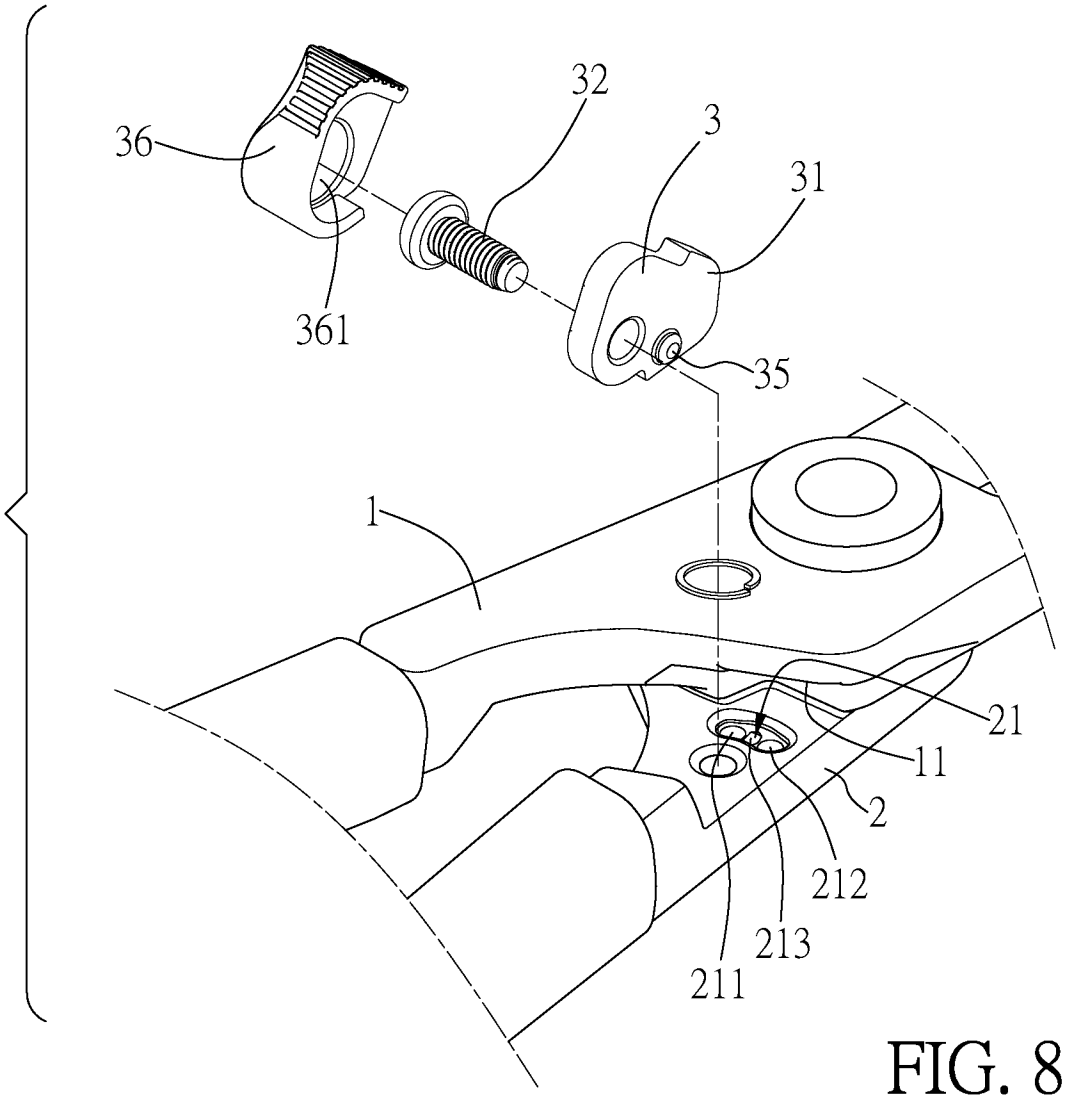
FIG. 8 illustrates an exploded view of a pliers according to a second embodiment of the present invention.

Furthermore, FIG. 8 illustrates a pliers according to a second embodiment of the present invention. In this embodiment, the tap-button mechanism 3 further comprises a housing 36 covering the tap button 3, and the housing 36 comprises a receiving groove 361 corresponding to the shaft 32 for receiving the shaft 32. Therefore, the shaft 32 is limited and protected in the housing 36. When the pliers is impacted, the shaft 32 would not be detached from the pliers easily to prevent the function failure of the tap button 3.

Figure 9:
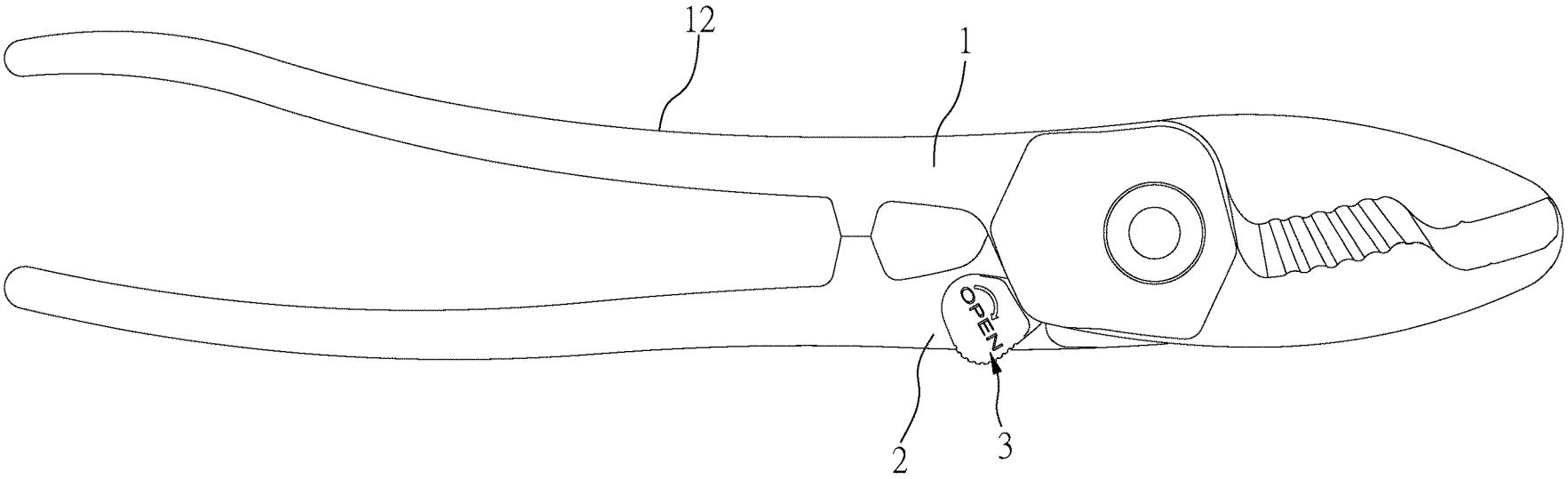
FIG. 9 illustrates a plan view of a pliers according to a third embodiment of the present invention.
Figure 10:
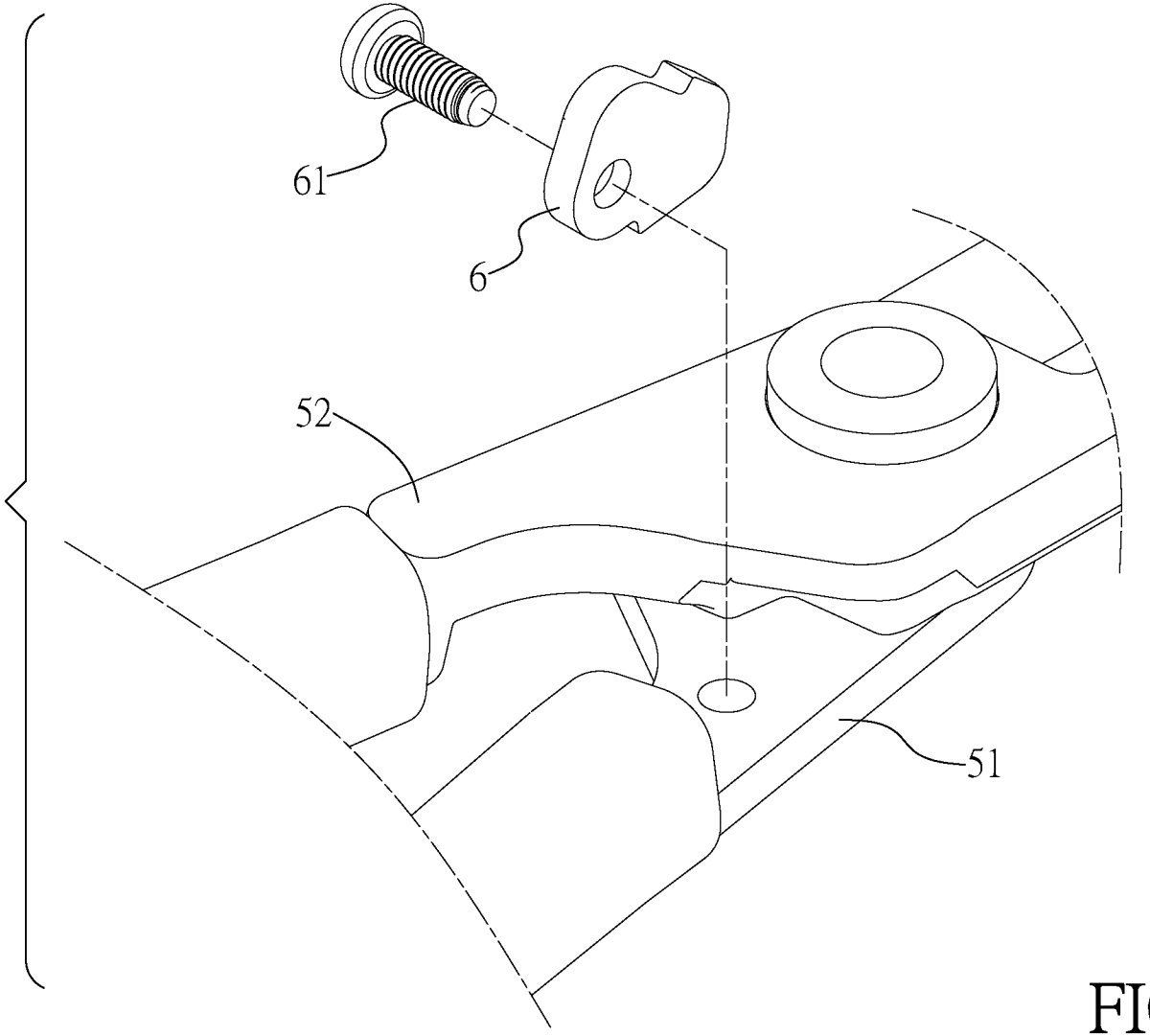
FIG. 10 PRIOR ART
FIG. 10 illustrates an exploded view of a conventional pliers.

FIG. 9 illustrates a pliers according to a third embodiment of the present invention. In this embodiment, the first pliers body 1 has a surface 12 being arced and inwardly recessed. The user can use four fingers to hold the surface 12 and tap the tap button 3 with the thumb, so that the user can operate by one hand.

What is claimed is:

1. A pliers, comprising:

a first pliers body having an engaging groove;

a second pliers body pivoted with the first pliers body, so that the first pliers body is pivotable relative to the second pliers body to come close to the second pliers body or goes away from the second pliers body, the engaging groove faced to the second pliers;

a curve-shape elongated slot, disposed on the second pliers body, including a left positioning groove, a right positioning groove and a protruding portion provided between the left and right positioning grooves;

a tap button with a blocking portion formed at a front end thereof, the tap button facing the second pliers body with a bottom surface and being pivoted on the second pliers body, the bottom surface being provided with an elastic positioning block extending toward the elongated slot and selectively inserting into the left or right positioning groove, the tap button being positioned with the positioning block stopped laterally by the protruding portion, wherein when the first pliers body comes close to the second pliers body, the tap button is capable of being rotatably tapped to make the positioning block cross over the protruding portion and insert into the left engaging groove, so that the first pliers body is blocked by the blocking portion locating in the engaging groove and cannot pivot relative to the second pliers body; the tap button is capable of being rotatably tapped to make the positioning block cross the protruding portion and shift into the right positioning groove for detaching the blocking portion from the engaging groove, so that the first pliers body is pivotable relative to the second pliers body; and a supporting member disposed between the second pliers body and the bottom surface of the tap button to push the tap button away from the second pliers body.

2. The pliers according to claim 1, wherein the supporting member is a broken ring with two ends leave away from each other, one end being higher than the other end.

3. The pliers according to claim 1, wherein the tap button is covered by a housing.

4. The pliers according to claim 3, wherein the tap button is pivoted on the second pliers body by a shaft, and the housing comprises a receiving groove corresponding to the shaft.

* * * * *